US005361747A

United States Patent [19]

Laabs

[11] Patent Number: 5,361,747

[45] Date of Patent: Nov. 8, 1994

[54] NOCKING SYSTEM FOR ARCHERY

[75] Inventor: Roberto Laabs, Berlin, Germany

[73] Assignee: "Amerika-Bogen" Handelsgesellschaft mbH, Duisburg, Germany

[21] Appl. No.: 888,816

[22] Filed: May 27, 1992

[30] Foreign Application Priority Data

May 28, 1991 [DE] Germany ..... 9106655[U]
Dec. 30, 1991 [DE] Germany ..... 9116149[U]

[51] Int. Cl.[5] ..... F41B 5/14; F42B 6/02
[52] U.S. Cl. ..... 124/91; 273/416
[58] Field of Search ..... 124/23.1, 24.1, 35.2, 124/90, 91, 92; 273/416, 420, 423

[56] References Cited

U.S. PATENT DOCUMENTS

| | | | |
|---|---|---|---|
| 1,785,589 | 12/1930 | Mead | 124/91 X |
| 2,777,437 | 1/1957 | Allen | 124/91 |
| 3,010,446 | 11/1961 | Frantello | 124/35.2 X |
| 4,151,825 | 5/1979 | Cook | 124/91 X |
| 4,981,128 | 1/1991 | Garvison | 124/35.2 |
| 5,141,229 | 8/1992 | Roundy | 273/416 |
| 5,154,432 | 10/1992 | Saunders | 273/416 |

FOREIGN PATENT DOCUMENTS

| | | | |
|---|---|---|---|
| 3447318 | 7/1986 | Germany | 273/416 |
| 8404497 | 5/1987 | Germany . | |

*Primary Examiner*—Randolph A. Reese
*Assistant Examiner*—John Ricci
*Attorney, Agent, or Firm*—Spencer, Frank & Schneider

[57] ABSTRACT

A nocking system for use in archery includes a plastic nock element at the end of an arrow and a plastic nocking member carried on a bowstring to cooperate with the nock element when the arrow is shot. The nock element has a spherically concave receptacle between a pair of nock wings. The nocking member is spherically convex and fits into the receptacle. Such an arrangement permits the nock element and the nocking member to rotate relative to one another in any direction, which improves accuracy when the arrow is shot while protecting the bowstring from wear. The nocking member may be a ball with a central bore which is threaded so that the archer can screw the ball to a desired position on a nocking region of the bowstring, the bowstring having a yarn winding at the nocking region. The nocking member may also be two ball-halves that are joined together at the nocking region between two yarn windings. The nocking wings of the nock element have tabs which grip the ball.

19 Claims, 7 Drawing Sheets

NOCKING SYSTEM FOR ARCHERY

CROSS REFERENCE TO RELATED APPLICATIONS

This application claims the priority of German Application G 91 06 655.7, filed May 28, 1991, and German Application G 91 16 149.5, filed Dec. 30, 1991, the subject matter of these applications being incorporated herein by reference.

BACKGROUND OF THE INVENTION

The present invention relates to a nocking system for archery, and more particularly to a nock element fastened to the rear end of an arrow shaft and a nocking member which cooperates with the nocking element and which is carried by the bowstring of a sporting or hunting bow.

It is known to form a nocking point on a bowstring by winding a predetermined portion of the bowstring with yarn. The nock, which forms the rear section of the arrow, is placed onto the yarn, which is wound with abutting layers, so as to be released relatively easily. In order to accurately center the arrow and guide it to its position, a metal ring encircles the wound yarn at a location on the bowstring that has been measured out by the archer. This metal ring is clamped on with pliers.

This arrangement has the drawback that the arrow receptacle formed at the nocking point by the wound yarn very quickly wears out, since the wound yarn becomes loose and may be displaced or broken after a relatively short period of use. The arrow receptacle becomes too inaccurate with respect to its required diameter and consequently becomes useless for the archer. Another significant drawback is that, when the bow is drawn, the nock element is no longer in active engagement with the bowstring over its entire base surface. This results in increased clamping action on the part of the nock element on the bowstring and in undesirable tilting forces which lead to a considerable reduction in hitting accuracy. The same drawbacks are also exhibited by nocking points that are provided with several layers of wound yarn.

German Utility Model Patent GM 84/04,497 discloses a nocking member for use with arrows shot by hunting and sporting bows. The nocking member is composed of two essentially cylindrical shell elements having semi-circular cross sections. The shell elements encase the bowstring in a form-fitting manner and are provided with two spaced, radially projecting ring-shaped attachments. The portion of the nocking member that receives the arrow is delimited by these attachments. The half-shells are fastened to the bowstring with several windings of yarns that engage extensions of the shell elements provided next to the attachments.

Although this arrangement is able to withstand greater mechanical stresses than simply providing yarn windings, and thus has a longer service life, the connection between the nock element and the nocking member has a relatively great rigidity which, when the bowstring is tensioned, produces an effect that adversely influences hitting reliability due to the deviation of the bowstring from the vertical direction in the holding region.

SUMMARY OF THE INVENTION

It is an object of the present invention to improve the hitting accuracy of archery equipment of the above-mentioned type.

The present invention includes the realization that, in the prior art, mechanically active connection with the trough-shaped basic surface of the arrow's nock is no longer complete when the bow is fully drawn, particularly if the relevant region of the bowstring is deflected obliquely. An undesirable clamping effect results at the nock, and forces are generated that adversely affect the hitting accuracy.

A particular advantage of the nocking system of the present invention is that it does not generate undesirable forces that might adversely influence hitting accuracy. According to the present invention, a ball joint composed of a ball receptacle for accommodating a ball is able to transfer force without problems and without generating tilting forces even if the axes of the joint components are at an angle to one another. This is possible since a full-area active contact exists at all times between the receptacle and the ball even if the ball is rotated.

According to a preferred embodiment of the invention, the nock element of an arrow has an initial portion with an essentially cylindrical shaft, an intermediate portion with a concave receptacle, and a rear portion formed by two nock wings. The associated nocking member is composed of a ball fastened to the bowstring in such a manner that the bowstring extends through the ball essentially at its center. The ball is dimensioned so that it can be received by the receptacle in a freely rotatable manner. This makes it possible to transfer force from the bowstring through the nock element to the arrow's shaft over the entire surface area at which the ball is in active engagement with the receptacle of the nock element even if the bow is fully drawn. Another advantage is that the surface area provided for force transfer remains essentially constant independently of the extension of the bowstring when the bow is drawn. The nock wings of the nock element are each provided with at least one detent means on their interior faces, preferably in the form of an inwardly oriented holding tab. These detent means cause the ball, after the arrow has been placed onto it, to remain within the receptacle during preparation for shooting, and to leave the receptacle only when the arrow is released.

The shaft portion of the nock element may be provided with an axially extending blind bore, and the intermediate portion may be provided with an external collar. In this way, the shaft of the arrow can be connected with the shaft portion of the nock element in a firm seat by inserting it up to its collar. The shaft portion of the nock element can also be configured as a solid cylinder of a constant diameter or with one setback step. The shaft portion of the nock element can also be configured so as to conically taper in the direction of the arrow shaft. At its forward end the tapered shaft portion is provided with a cylindrical pin which is surrounded by a plurality of spring elements. The arrow shaft is inserted into an annular space between spring elements and the pin.

The nocking member may be a ball which is provided with a threaded bore. In this way, the ball can be easily screwed onto wound yarn that is disposed on the bowstring in the nocking region. If the length of the winding is selected to be greater than the diameter of the ball, the latter can be adjusted to its optimum position by simple rotation once the bow has been in use for a period of time. The contact pressure generated by the screwing action between the wound yarn and the ball and between the wound yarn and the bowstring is advantageous for reliable positioning of the ball. In order to keep the mechanical stress on the bowstring from the ball as low as possible during frequent use of the bow, the bore disposed in the ball is given a chamfer at both ends.

For simple stress cases, the ball may be fastened in the desired position by means of delimiting elements that are disposed on the bowstring above and below the ball. A yarn winding is particularly suitable as a delimiting element since it is sufficiently elastic not to mechanically stress the bowstring and since it can be placed easily close to the ball.

The ball can be formed by combining two essentially identical ball halves. For this purpose, several connecting elements are disposed on the interior faces of the ball halves. In the simplest case, they are composed of pins which extend into bores of suitable diameter. The ball halves are connected by plugging them together, with the use of an adhesive further improving the strength of the plug-in connection.

Particularly when plastic is used for the ball halves, connecting elements in the form of snap-together buttons may be used for connecting the ball halves. The ball halves can be easily manufactured by injection molding and are easily manipulated for joining.

DESCRIPTION OF THE PREFERRED EMBODIMENTS

Figure 13:
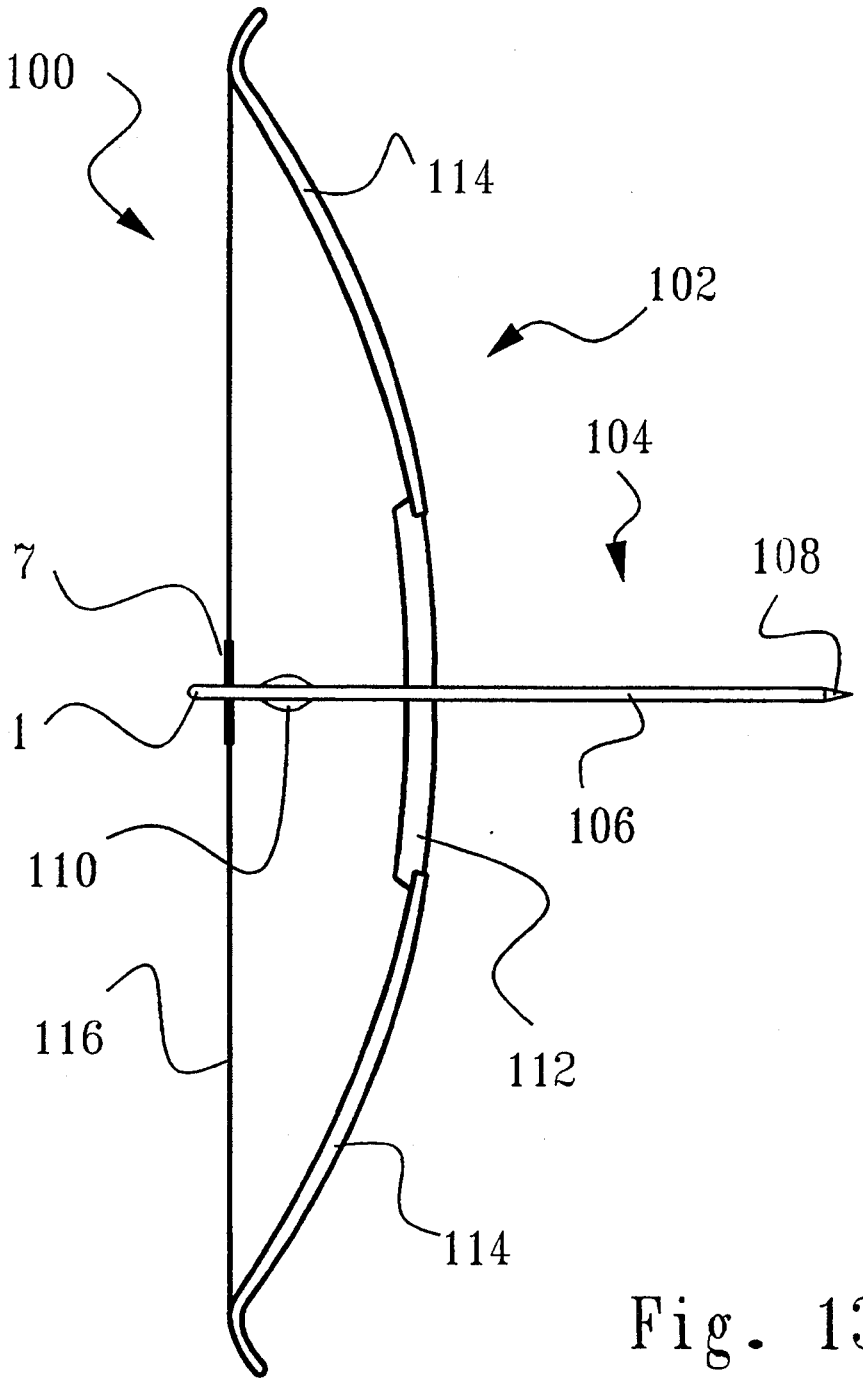
FIG. 13 is a side elevational view illustrating a weapon having a nocking system in accordance with the present invention.

FIG. 13 illustrates a weapon 100 having a nocking system in accordance with the present invention. Weapon 100 includes a bow 102 and an arrow 104. Arrow 104 has an arrow shaft 106. An arrow point member 108 is attached to shaft 106 at its front end and feathers 110 are attached to shaft 106 at a position near its rear end. A nock element 1 is attached to shaft 106 at its rear end. Bow 102 has a handle 112 and bow limbs 114 which are attached to the handle. A bowstring 116 is stretched between limbs 114. Bowstring 116 has a nocking region 7 which is wound with yarn. Although not shown in FIG. 13, a nocking member is attached to bowstring 116 at nocking region 7 to cooperate with the nock element 1.

Figure 1:
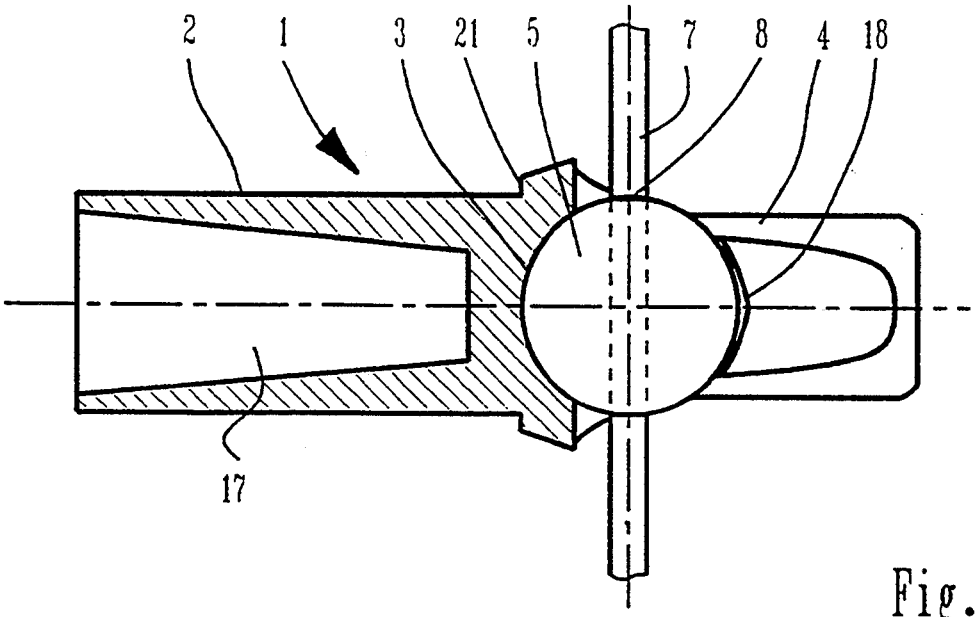
FIG. 1 is a schematic representation, partially in section, of a nock element engaged by a nocking member that is mounted on a bowstring, the bow being in an undrawn state.
Figure 2:
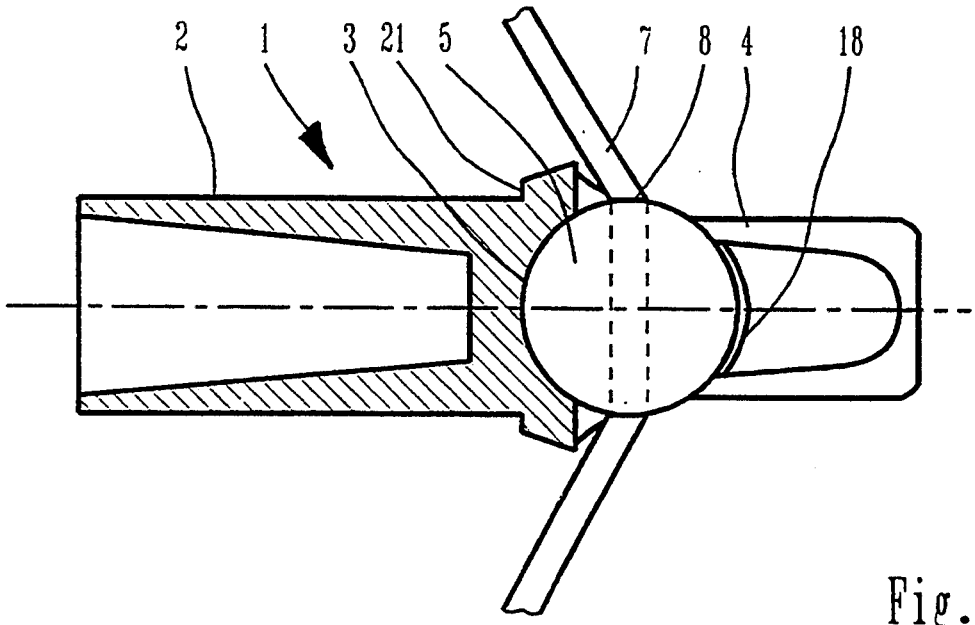
FIG. 2 is a schematic representation, partially in section, of the nock element and nocking member of FIG. 1 when the bow is in a drawn state.

Turning next to FIGS. 1 and 2, which are partially in section, a ball 5 serves as the nocking member. Nock element 1 has a receptacle 3 which receives ball 5 in the manner of a universal ball joint. Receptacle 3 is three-dimensionally concave; that is, it is concave with respect to two orthogonal planes (such as the vertical and horizontal planes). FIG. 2 depicts the elements when the bow is in the drawn or tensioned state and FIG. 1 shows the elements when the bow is in the undrawn or untensioned state.

Receptacle 3 is delimited at two sides by identically configured elastic nock wings 4. Each of nock wings 4 has an interior face with a detent means in the form of an interiorly oriented holding tab 18. The tabs 18 hold the ball 5 within receptacle 3 when the archer, in preparation for a shot, brings the bow to the required position. When the bow is tensioned, the ball 5 lies fully against the bottom region of receptacle 3 so that the transfer of forces can take place from the bowstring to the arrow without the generation of tilting forces. This is of considerable significance for increasing the archer's hitting accuracy.

Figure 3:
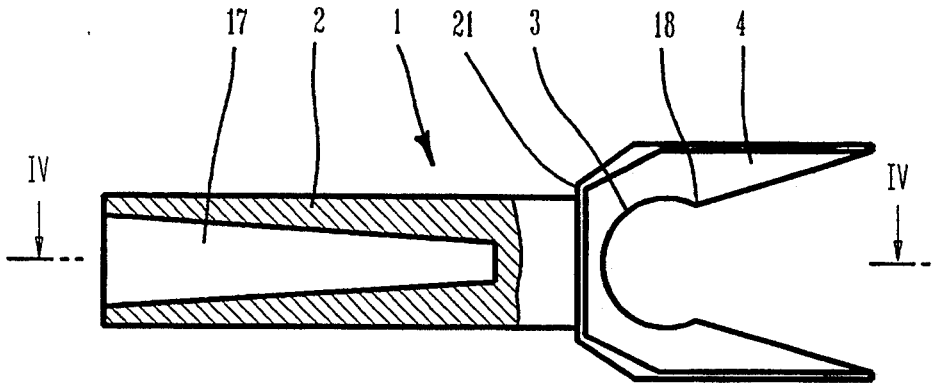
FIG. 3 is a schematic top view, partially in section, of an embodiment of the nock element.
Figure 4:
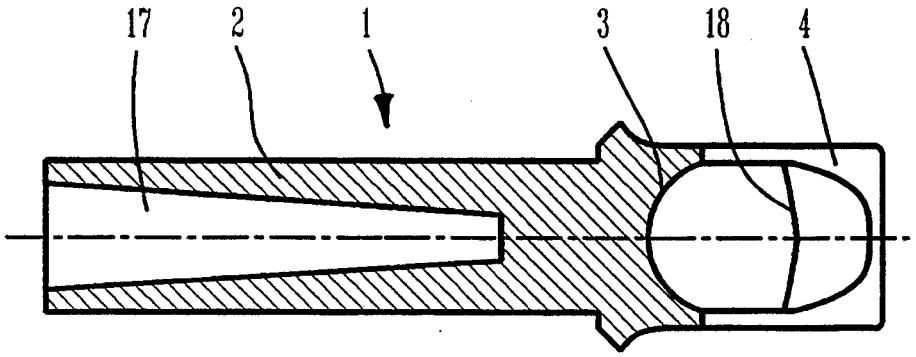
FIG. 4 is a sectional view along line IV—IV of FIG. 3.

In the preferred embodiment of the invention, nock element 1 has a cylindrical shaft portion 2. The receptacle 3 is provided at an intermediate portion which is disposed at the end of shaft portion 2 facing away from the arrow. Shaft portion 2 and receptacle 3 are separated from one another by a collar 21. In its interior, shaft portion 2 has an axial blind bore 17. In order to connect the arrow shaft with nock element 1, shaft portion 2 is inserted into a bore (not illustrated) at the end of the arrow shaft until collar 21 is reached. A pin (not illustrated) of dimensions that are adapted to the blind bore 17 is provided in the bore at the end of the arrow shaft to enable nock element 1 to be fastened to the arrow shaft in an axially accurately aligned manner. In FIGS. 3 and 4 nock element 1 is shown schematically in a partial sectional view and in a longitudinal sectional view, respectively.

Figure 5A:
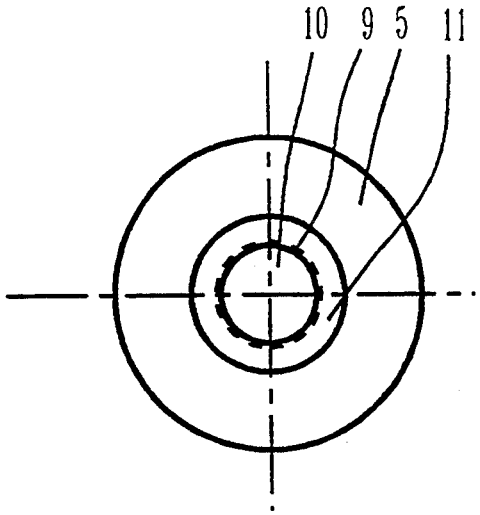
FIGS. 5A and 5B schematic representations, in a top view and in cross section, respectively, of an embodiment of the nocking member.
Figure 5B:
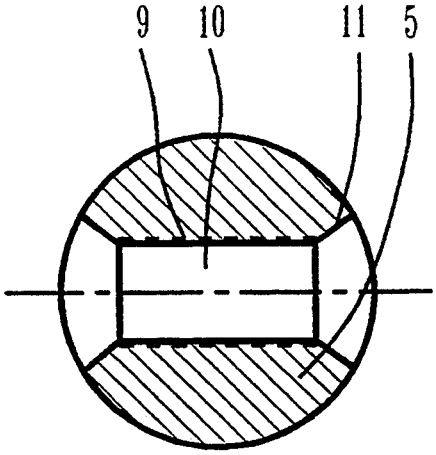

Ball 5, which is employed as the nocking member, is shown in a top plan view in FIG. 5A and in a sectional view in FIG. 5B. Ball 5 has a central bore 10 provided with a chamfer 11 at each end. As shown in FIGS. 1 and 2, the nocking region 7 of the bowstring extends through bore 10. In order to position ball 5 accurately and reliably on the bowstring, bore 10 is provided with a suitable thread 9. In this way it is possible to easily screw ball 5 onto the yarn 8 (see FIG. 7) wound on the bowstring in the nocking region 7.

Figure 6A:
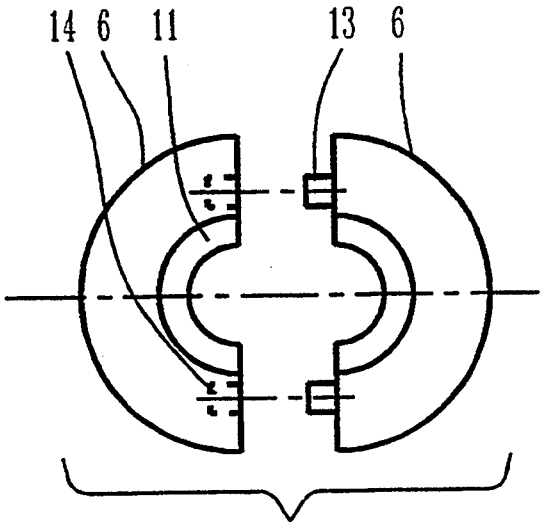
FIGS. 6A and 6B are schematic representations, in a top view and a side view, respectively, of another embodiment of the nocking member.
Figure 6B:
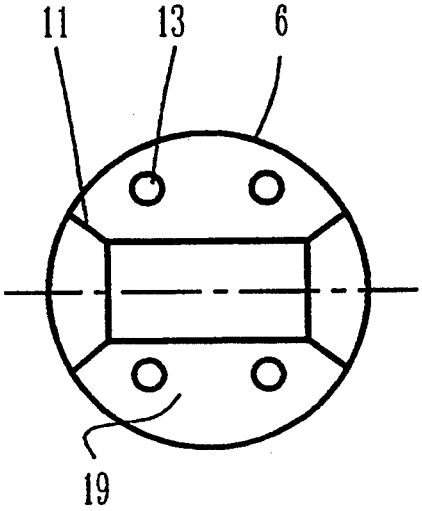

According to a favorable modification of the invention shown in FIGS. 6A and 6B, the ball may be composed of two essentially identically configured ball halves 6 which are plugged together by the use of several connecting elements composed of pins 13 and mating bores 14 disposed on the interior faces 19 of ball halves 6. Seen in cross section, the pins are preferably slightly rounded so that, in cooperation with the correspondingly configured bores, a snap-button-like snap effect is produced. FIG. 6A shows the dividable embodiment in a top view and FIG. 6B shows a side view of one of the ball halves.

Figure 7:
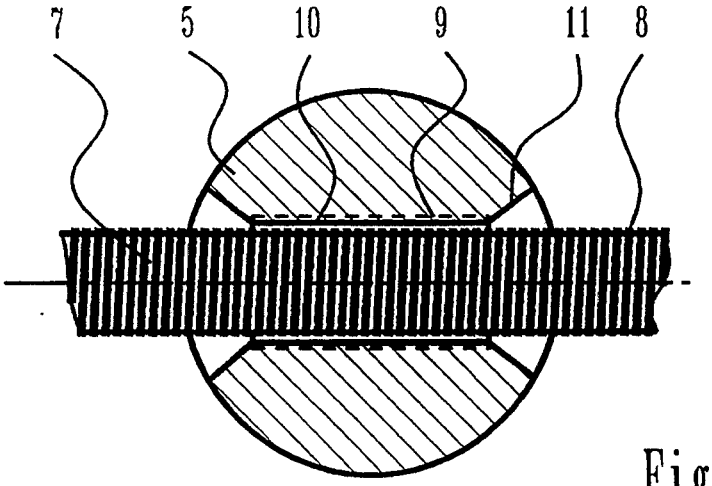
FIG. 7 is a side view, partially in section, schematically illustrating a way of fastening the ball of FIGS. 5A and 5B on the nocking region of the bowstring.

FIG. 7 is a schematic longitudinal sectional view of a one-piece ball 5 showing the position of threaded bore 10 relative to the wound yarn 8 disposed on the bowstring at nocking region 7. The ball 5 has been advanced to a desired location by a screwing process. Since the length of winding 8 (if required) is selected to be larger than the length of bore 10, the position of ball 5 can be adapted to the optimum shooting conditions for the arrows, if necessary even during a competition, by simple rotation. By suitable selection of the diameter of nocking region 7 and bore 10, the screwing of ball 5 onto the bowstring produces a sufficient degree of pressure between the ball and the bowstring to ensure a defined position of the nocking member even after frequent use of the bow.

Figure 8:
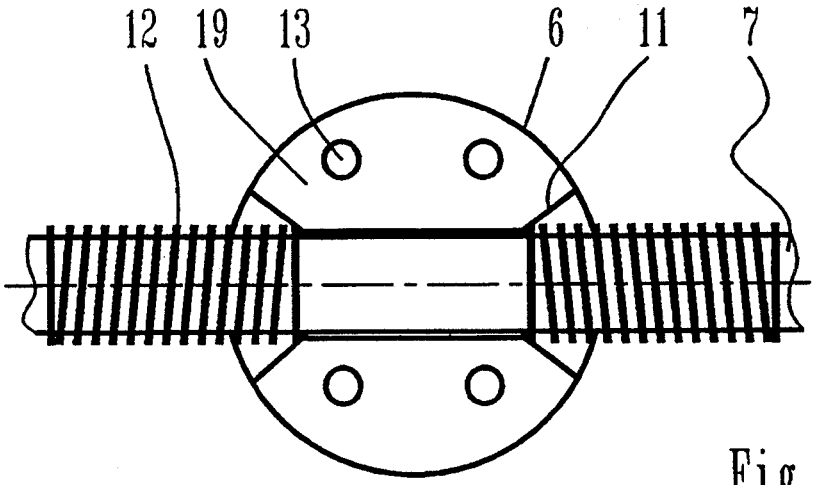
FIG. 8 is a side view schematically representing a way of fastening the ball halves of FIGS. 6A and 6B on the nocking region of the bowstring.

If a nocking member composed of two ball halves 6 is used, the nocking region 7 is effected by two spaced-apart yarn windings 12 on the bowstring. FIG. 8 shows the interior face 19 of a ball half 6 which has been inserted on the bowstring between the yarn windings before the other ball half 6 is joined to it. The diameter of the bore resulting after joining is less than the outer diameter of the windings 12, so that the axial mobility of the ball is blocked by the pressure generated in the region of chamfer 11. Chamfer 11 advantageously serves to limit the mechanical stress on the bowstring in the region of the nocking member when the bow is tensioned.

Figure 9:
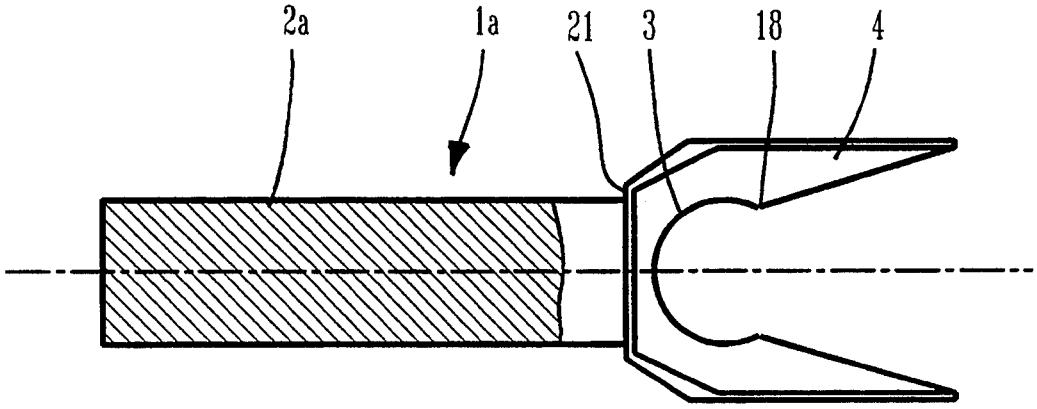
FIG. 9 is a top view, partially in section, schematically illustrating a further embodiment of a nock element.
Figure 10:
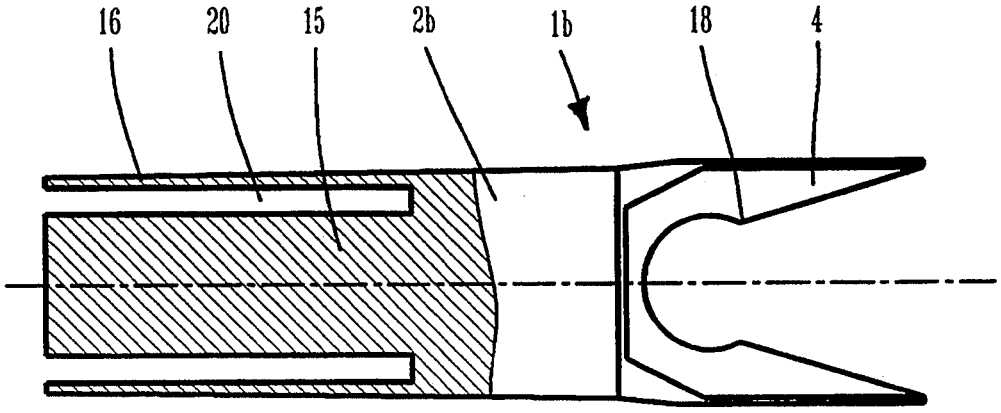
FIG. 10 is a top view, partially in section, schematically illustrating an additional embodiment of a nock element.
Figure 11:
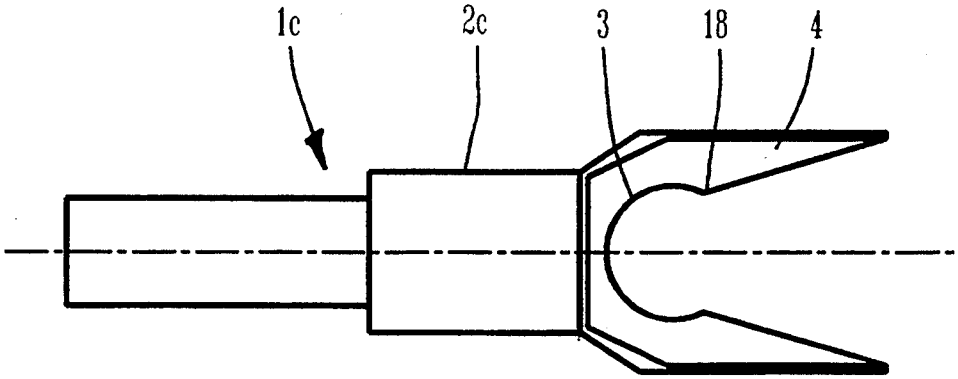
FIG. 11 is a top view schematically illustrating yet another embodiment of a nock element.

FIGS. 9, 10, and 11 show nock elements 1A, 1B, and 1C with differently configured shaft portions 2A, 2B, and 2C. In the simplest case, the shaft portion 2A according to FIG. 9 (a top view, partially in section) is composed of a solid cylinder. This is followed by an intermediate portion having a collar 21, and a receptacle 3, which in turn is followed by a rear portion with two nock wings 4 which are provided with detent means. To connect the arrow shaft with nock element 1A, the shaft portion 2A is inserted into a bore (not illustrated) at the end of the arrow shaft until it is stopped by collar 21. The shape of shaft portion 2B shown in FIG. 10 (a top view, partially in section) is suitable for improved axial alignment between the nock element and the arrow shaft. Shaft portion 2B is slightly tapered and, at its end on the side of the arrow shaft, is provided with a cylindrical pin 15 which is separated by an annular space 20 from several axially extending and uniformly distributed spring elements 16. The pin 15 fits into a bore (not illustrated) at the end of the arrow shaft, and the nock element 1B is additionally fixed by the spring elements 16. Nock element 1C, shown in FIG. 11 in a top view, is provided with a cylindrical shaft portion 2C which has a stepped diameter. The shaft portion 2C is pushed into a bore (not illustrated) at the end of an arrow shaft until it is stopped by the section of shaft portion 2C which has a larger diameter. The large contact area created by the step in the diameter is of advantage for accurately positioning nock element 1C onto the arrow shaft.

Figure 12:
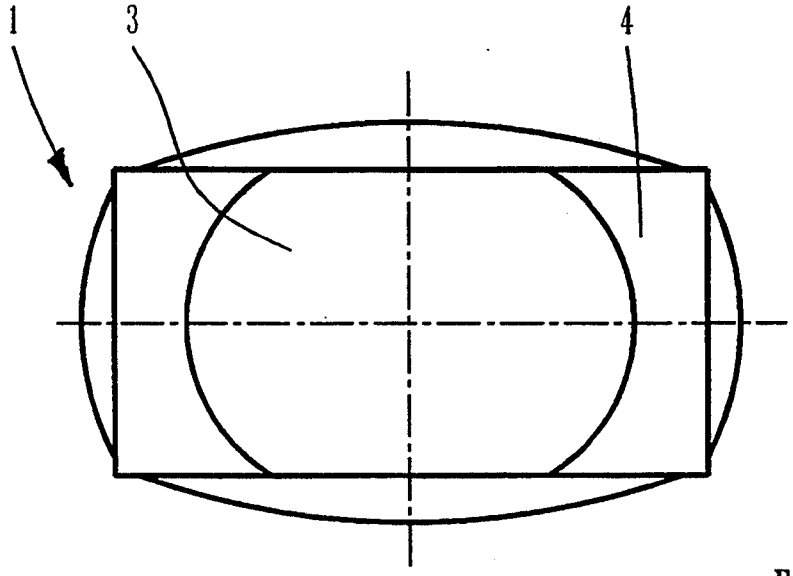
FIG. 12 is a schematic rear view of the nock element embodiment shown in FIG. 3.

FIG. 12 is a schematic representation of nock element 1 as seen from the rear, in the direction of the arrow shaft. The nock wings 4 delimit the sides of receptacle 3, which has a contact surface for the nocking ball at its bottom region. This contact surface is smaller than the total surface area of a corresponding ball section having the same diameter. Thus it is possible to reduce the friction between the nocking ball member and the receptacle while providing for sufficient force transfer by way of the nock element 1.

In the illustrated embodiments, the nock elements (i.e., reference numbers 1, 1A, 1B, and 1C) and nocking members (i.e., reference numbers 5 and 6) are composed of plastic, with the nock element, in particular, being manufactured of polycarbonate (PC) and the nocking member of polyoxymethylene (POM).

The present invention is not limited in its embodiments to the above-described preferred embodiments. Rather, a number of variations are conceivable which take advantage of the described solution even for basically different configurations.

What is claim is:

1. An improved nocking system for archery, the nocking system including a nock element fastened to the rear end of an arrow shaft and a nocking member carried by a bowstring, wherein the improvement comprises:

the nocking member has a spherically convex surface and the nock element has a correspondingly spherically concave receptacle for the nocking member, so that the nocking member and the nock element are rotatable relative to one another in any direction.

2. The nocking system of claim 1, wherein the nock element includes a generally cylindrical shaft portion, an intermediate portion with the spherically concave receptacle, the intermediate portion being connected to the shaft portion, and two nock wings extending from the intermediate portion.

3. The nocking system of claim 1, wherein the nocking member comprises a ball, the bowstring extending through the center of the ball.

4. The nocking system of claim 1, wherein the nocking member comprises a ball having a central bore, the bore being threaded.

5. The nocking system of claim 4, wherein the bore has bore ends, the bore ends being chamfered.

6. The nocking system of claim 1, wherein the bowstring has a central region with a yarn winding, and wherein the nocking member has a threaded bore by which the nocking member can be screwed onto the yarn winding.

7. The nocking system of claim 1, wherein the bowstring has a central region with two adjacent yarn windings, the nocking member being mounted on the bowstring between the windings.

8. The nocking system of claim 1, wherein the nocking member comprises a first generally hemispherical member having an inner side, a second generally hemispherical member having an inner side, and means for connecting the generally hemispherical members together with their inner sides facing one another.

9. The nocking system of claim 8, wherein the means for connecting comprises a pin extending from the inner side of one generally hemispherical member into a bore in the inner side of the other generally hemispherical member.

10. The nocking system of claim 9, wherein the means for connecting further comprises adhesive on the pin and in the bore.

11. The nocking system of claim 8, wherein the means for connecting the generally hemispherical members together comprises means for snap-connecting the generally hemispherical members together.

12. The nocking system of claim 1, wherein the nock element comprises an intermediate portion having the spherically concave receptacle, and a pair of resilient nock wings extending from the intermediate portion in a generally fork-shaped configuration.

13. The nocking system of claim 12, wherein the nock wings have inner sides with holding tabs.

14. The nocking system of claim 1, wherein the nock element comprises a tapered shaft portion for connection to the arrow shaft, the tapered shaft portion of the nock element including a cylindrical pin and a plurality of spring elements which surround the pin and which are spaced apart from the pin by an annular gap.

15. The nocking system of claim 1, wherein the nock element is made of polycarbonate and the nocking member is made of polyoxymethylene.

16. An arrow for use with a bow which is strung with a bowstring having a ball attached thereto, comprising:

an arrow shaft having a rear end; and a nock element attached to the rear end of the arrow shaft, the nock element having a three-dimensionally concave receptacle to rotatably receive the ball, the nock element additionally having a pair of nock wings symmetrically disposed about the receptacle.

17. The arrow of claim 16, wherein the nock element has an axis that coincides with the axis of the arrow shaft, and wherein at least a portion of the receptacle is radially symmetrical with respect to the axis of the nock element.

18. The arrow of claim 17, wherein the at least a portion of the receptacle that is radially symmetrical with respect to the axis of the nock element has a surface that is configured as a three-dimensional part of the surface of a sphere.

19. The arrow of claim 18, wherein the nock wings are resilient and have inner sides, and further comprising holding tabs on the inner sides of the nock wings to engage the ball.

* * * * *